US011091340B2

(12) United States Patent
Perini et al.

(10) Patent No.: US 11,091,340 B2
(45) Date of Patent: Aug. 17, 2021

(54) REWINDER FOR THE PRODUCTION OF PAPER LOGS

(71) Applicant: FUTURA S.P.A., Capannori (IT)

(72) Inventors: Fabio Perini, Viareggio (IT); Giovacchino Giurlani, Segromigno in Monte Capannori (IT); Francesco Pelaia, Sarzana (IT)

(73) Assignee: FUTURA S.P.A., Capannori (IT)

( * ) Notice: Subject to any disclaimer, the term of this patent is extended or adjusted under 35 U.S.C. 154(b) by 322 days.

(21) Appl. No.: 16/462,265

(22) PCT Filed: Oct. 30, 2017

(86) PCT No.: PCT/IT2017/000236

§ 371 (c)(1),
(2) Date: May 20, 2019

(87) PCT Pub. No.: WO2018/092167

PCT Pub. Date: May 24, 2018

(65) Prior Publication Data

US 2019/0337748 A1 Nov. 7, 2019

(30) Foreign Application Priority Data

Nov. 21, 2016 (IT) ..... 102016000117182

(51) Int. Cl.
*B65H 19/28* (2006.01)
*B65H 19/22* (2006.01)
*B65H 20/16* (2006.01)

(52) U.S. Cl.
CPC ..... *B65H 19/283* (2013.01); *B65H 19/2269* (2013.01); *B65H 20/16* (2013.01);
(Continued)

(58) Field of Classification Search
CPC .. B65H 19/283; B65H 19/2269; B65H 20/16; B65H 2301/4189; B65H 2301/522;
(Continued)

(56) References Cited

U.S. PATENT DOCUMENTS 1,992,114 A * 2/1935 Battison ..... B65H 18/16 242/532.7
2,862,705 A * 12/1958 Faeber ..... F26B 13/107 226/92

(Continued)

FOREIGN PATENT DOCUMENTS

EP 1700805 A2 9/2006
EP 1721847 A2 11/2006

(Continued)

OTHER PUBLICATIONS

Translation of International Search Report and Written Opinion of the International Search Authority dated Mar. 15, 2018 in corresponding International application No. PCT/IT2017/000236; 10 pages.

*Primary Examiner* — William A. Rivera
(74) *Attorney, Agent, or Firm* — Maier & Maier, PLLC

(57) ABSTRACT

Rewinder for the production of paper logs adapted to guide and transversely pre-cut a paper web along a predetermined path, adapted to wind a predetermined amount of the paper web on a core in a winding station, and including a threading mechanism for threading the web along said path. The threading mechanism includes a dragging unit provided to engage the web to drag it along the path with a predetermined feed direction and at least one dragging member to engage a respective flap of the web preceding the production of the logs. The dragging unit is located downstream of the winding station and is adapted to release the flap of the web from the dragging member, the release means being
(Continued)

arranged downstream of the dragging so as to intercept the flap of the web and disengage it from the dragging while the web is fed.

11 Claims, 11 Drawing Sheets

(52) U.S. Cl.
CPC ..... *B65H 2301/4189* (2013.01); *B65H 2301/522* (2013.01); *B65H 2404/14* (2013.01)

(58) Field of Classification Search
CPC ..... B65H 2404/14; B65H 2408/235; B65H 19/22; B65H 19/28; B65H 23/04; B65H 18/16; B65H 20/06; B65H 2404/262; B41F 13/02; B41F 13/03; D21G 9/0072
See application file for complete search history.

(56) References Cited

U.S. PATENT DOCUMENTS 4,480,801 A * 11/1984 Stone ..... B41F 13/03 101/228
4,706,862 A * 11/1987 Theilacker ..... B41F 13/03 101/228
4,987,830 A * 1/1991 Fukuda ..... B41F 13/03 101/228
5,400,940 A * 3/1995 Sato ..... B41F 13/03 101/228
5,996,873 A * 12/1999 Pimpis ..... B41F 13/03 101/228
6,321,967 B1 * 11/2001 Michalik ..... B41F 13/03 226/188
6,325,266 B1 * 12/2001 Suzuki ..... B41F 13/03 101/223
6,398,094 B1 * 6/2002 Alexander ..... B41F 13/03 101/228
6,425,513 B1 * 7/2002 Madrzak ..... B65H 20/16 226/172
2002/0024175 A1 * 2/2002 Marmin ..... B41F 13/03 270/20.1
2002/0108515 A1 * 8/2002 Lepeltier ..... B41F 13/03 101/228
2009/0057362 A1 * 3/2009 Menzinger ..... B41F 13/03 226/2
2013/0068874 A1 3/2013 Schwamberger et al.
2020/0180887 A1 * 6/2020 Blume ..... B65H 18/16

FOREIGN PATENT DOCUMENTS

EP 2909120 B1 10/2016
WO 2002/102594 A1 12/2002

* cited by examiner

REWINDER FOR THE PRODUCTION OF PAPER LOGS

FIELD

The present invention relates to a rewinder for the production of paper logs.

BACKGROUND

It is known that the production of paper logs, from which, for example, are obtained toilet paper rolls or kitchen paper rolls, implies feeding a paper web, consisting of one or more superimposed plies, along a predetermined path where several operations are performed prior to make the logs, including a transverse web incision to form pre-cutting lines that divide the web into separable tear-off sheets. The formation of logs involves the use of cardboard tubes, commonly known as "cores" on whose surface it is distributed a predetermined amount of glue to allow the bonding of the paper web onto the cores introduced into the log-forming machine that is commonly called "rewinder". The glue is distributed on the cores when they pass along a corresponding path comprising an end commonly called "cradle" due its concave conformation. The formation of the logs also implies the use of winding rollers placed in correspondence of the cradle, which determine the rotation of each core about its longitudinal axis thereby causing the winding of the web on the same core. One of said rollers is positioned lower than the cradle while other rollers are placed above the cradle. The process ends when a predetermined number of sheets is wrapped around the core and a portion of the last sheet is glued to the underlying sheet of the same roll (so-called "flap closure" operation). Upon reaching the predetermined number of sheets wrapped around the core, the last sheet of the almost completed log is separated from the first sheet of the next log, for example by means of a compressed air jet directed towards a corresponding pre-cutting line. At this point, the log is discharged from the rewinder.

EP1700805 discloses a rewinder that operates according to the operating scheme disclosed above. US2013/068874 also discloses a rewinder for the production of paper logs.

At a preliminary stage of the process, the paper web, fed by reels placed on respective unwinders, is carried in substantially manual mode up to the rewinder station that houses the winding rollers. In practice, an operator engages a flap of the paper web at a dragging belt that follows a path provided at a side of the path that will be followed by the web during the production of the logs. Subsequently, the operator, by operating the system in jog mode, from the inside of the rewinder, ensures that the paper web passes between the guide roller, the pre-cutting roller and the winding rollers of the rewinder. Once this step has been completed, the operator cuts the web flap attached to the dragging belt with a knife and removes the excess paper leaving the web in a non-tensioned state. At this point, the operator exits the rewinder and starts the logs production in the automatic mode.

However, at least the first log must be discarded because the rewinder is started with the paper web in a non-tensioned state. In addition, the procedure described above is inherently risky because the access of the operator inside the rewinder involves the deactivation of several accident prevention systems. In addition, there is the fact that the operators involved in this procedure must be adequately trained for relatively long periods of time.

SUMMARY

The main purpose of the present invention is to eliminate, or at least reduce, the aforesaid drawbacks. This result has been achieved in accordance with the present invention by providing a rewinder having the features indicated in claim 1. Other features of the present invention are the subject of the dependent claims. Thanks to the present invention, it is possible to reduce the risks connected with the paper web threading, to the benefit of operators safety. In addition, it is possible to reduce the scraps when the rewinder is started. It is also possible to automate almost the entire threading operation, which therefore does not necessarily have to be entrusted to highly skilled and trained personnel. Further advantages derive from the relative constructive and functional simplicity of the threading mechanism provided by a rewinder according to the present invention, which also allows to reduce the threading time and from the fact that the existing rewinders can be modified with relative simplicity to make them conform to the invention as the very logs formation cycle is not changed compared to the standard procedures.

These and further advantages and features of the present invention will be more and better understood thanks to the following description and the accompanying drawings, provided by way of example but not to be considered in a limitative sense, in which:

DETAILED DESCRIPTION OF THE DRAWING

Figure 2:
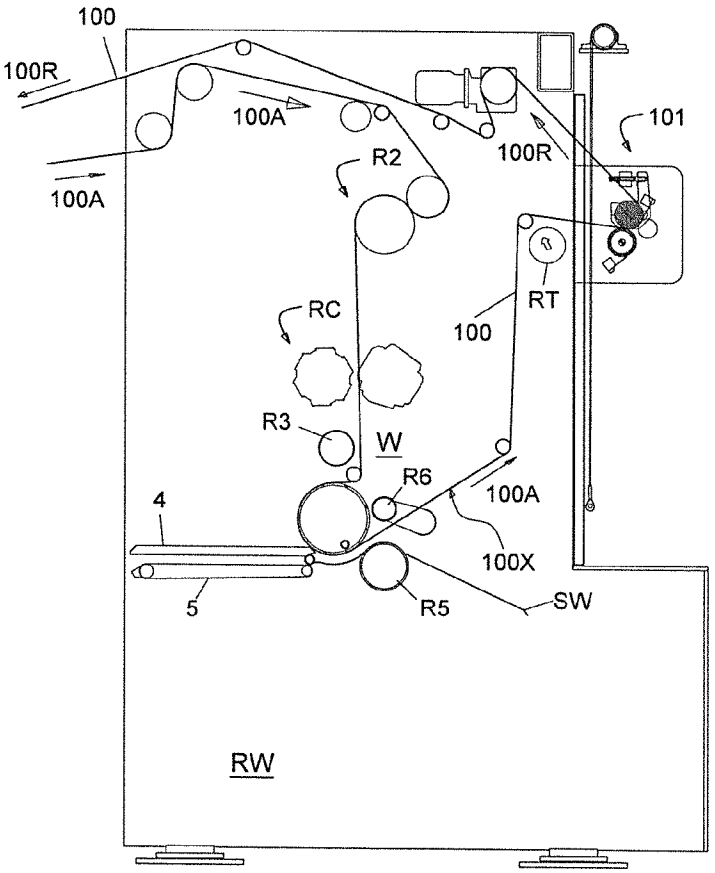
FIG. 2 represents a sequence of operative phases implemented by the machine of FIG. 1, some detail of the machine being omitted to better illustrate others.

Reduced to its essential structure and with reference to the enclosed drawings, a rewinder (RW) according to the present invention is of the type comprising:

- a cores feeding station (F) for feeding the cores (1) coming from an accumulator (S), in which a rotary feeder (not shown in the drawings) is arranged for engaging a core (1) at a time and introducing it into a guide where a glueing device (GD) is arranged and acting as further disclosed below;
- means for feeding and transversely pre-cutting a paper web (2) formed of one or more superimposed paper plies, with a set of guide rolls (R1, R2, R3) and pre-cutting rolls (RC) arranged along a predetermined web (2) feeding and pre-cutting path;
- means for wrapping, or winding, the paper web (2) on a core (1) in a winding station (W) with a first winding roller (R4) located downstream of said guide and pre-cutting rollers (R1, R2, R3, RC), and two additional winding rollers (R5, R6) arranged downstream of the first winding roller (R4) with respect to the direction followed by the cores (1) and the paper web: the second and the third winding roll (R5, R6) being arranged downstream of a curved guide (3) that, in cooperation with the first winding roller (R4), delimits a cradle-shaped channel (CH) downstream of the glueing device (GD), said channel being sequentially crossed by the cores (1) on which the glueing device (GD) distributes a predetermined amount of glue.

The first winding roller (R4) also has the function of guiding the paper web (2) coming from the guide and pre-cutting rollers positioned upstream.

The second roller (R5) is below the third roller (R6) of the winding station (W).

The third winding roller (R6) is mounted on the end of an arm (B6) connected to a respective actuator allowing it to approach, and respectively to move it away from, said channel in relation to the instantaneous diameter of the log being formed.

In said winding station (W) there is a chute (SW) on which the completed logs, once released by the roller (R6), can roll.

The system formed by the winding rollers (R4, R5, R6), the respective actuators and related control units are known. Also known are the way of removing a completed log (RO) from the winding station (W) and how to start the formation of a new log in the same station (W). The channel (CH) delimits the last part of the path followed by the paper web (2) and the cores (1) before entering the winding station (W).

On each core (1) is applied a predetermined amount glue allowing the web (2) to adhere to the same cores (1), according to a process known per se, while the cores (1) advance along a predetermined advancing direction (A), defined by the guide served by the cores feeder, to reach the winding station (W) where the logs are formed. For example, said guide is formed by a set motorized belts (5) driven by pulleys (50) whose axis is horizontal and orthogonal to said advancing direction (A), and a corresponding set of overlying fixed plates (4) having a prevailing longitudinal development (length higher than thickness and height). The motorized belts (5) engage the cores (1) coming from the feeding station (F), obliging them to rotate and advance upstream of the channel (CH).

The glueing device (GD) comprises two sets of dispensers (6) placed one after the other between the plates (4). The dispensers (6) distribute the glue, from the above, on the cores (1) along the path imposed by said guide (4, 5). Therefore, on each of the cores (1) passing through the guide (4, 5), it is applied a given amount of glue on two separate points, that serve for bonding the last sheet of a log formed in the station winding (W) with the underlying sheet of the same log and respectively for the adhesion of the first sheet of a new log to a corresponding core (1). Such a process of applying glue to the cores (1) is in itself known.

Furthermore, the rewinder is provided with a threading mechanism for threading the paper web (2) at a preliminary stage of the paper logs production process.

In accordance with the present invention, said threading mechanism comprises a dragging belt (100) arranged along a predetermined path on a side of the rewinder (RW), i.e. on a right or left side of the assembly formed by said guide, pre-cutting and winding rollers so as not to interfere with the latter. This path is a closed loop path passing through a paper web feed station arranged upstream of the rewinder (RW) and a dragging unit (101) arranged downstream of the winding station (W). The dragging unit (101) comprises two counter-rotating press rollers (102, 103) with parallel and superimposed axes provided downstream of the winding station (W). A blade (104) is disposed and acting on a side downstream of the press rolls (102, 103) for cutting the flap (2L) of the web (2) engaged to the dragging belt (100) during the preliminary stage of the paper logs production process.

As further disclosed below, the threading mechanism is configured to obtain a tensioning of the paper web (2) after the cut of the flap (2L) by means of the blade (104). According to the example shown in the accompanying drawings, the press rollers (102, 103) of the threading unit (101) are arranged with their respective longitudinal axes parallel to the axes of the guide, pre-cutting and winding rollers, i.e. are oriented transversely to the paper web (2).

Figure 8:
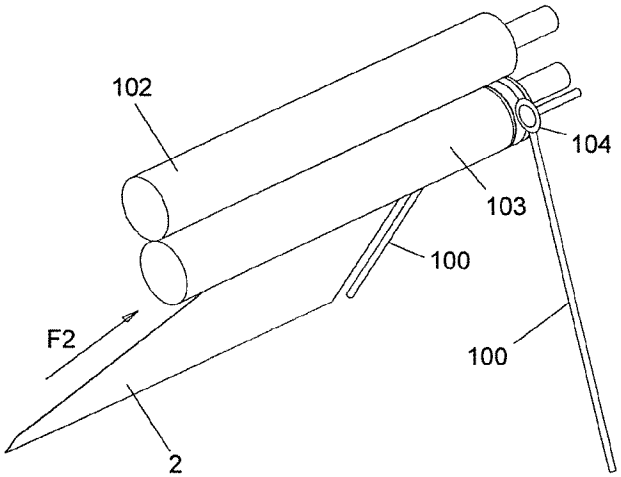
FIG. 8 schematically represents some components of the threading mechanism at different stages of the threading process.
Figure 7:
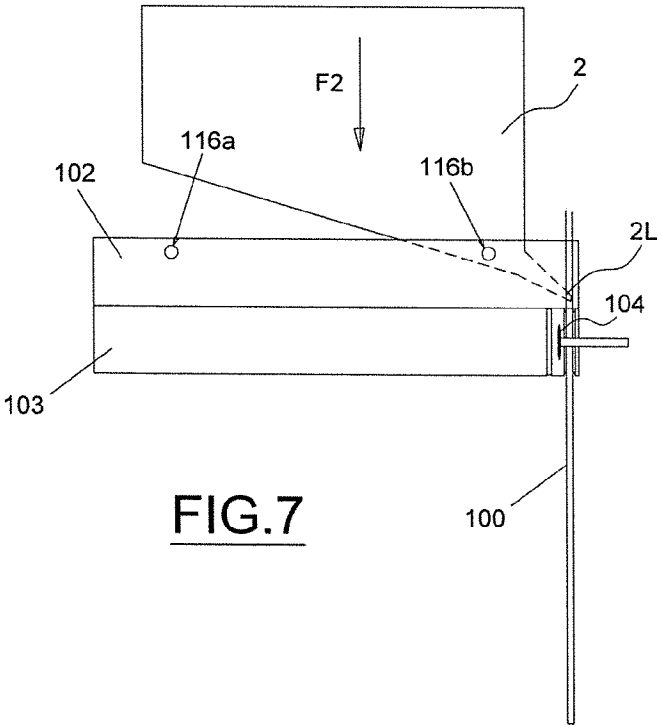
FIG. 7 schematically represents some components of the threading mechanism at different stages of the threading process.
Figure 10:
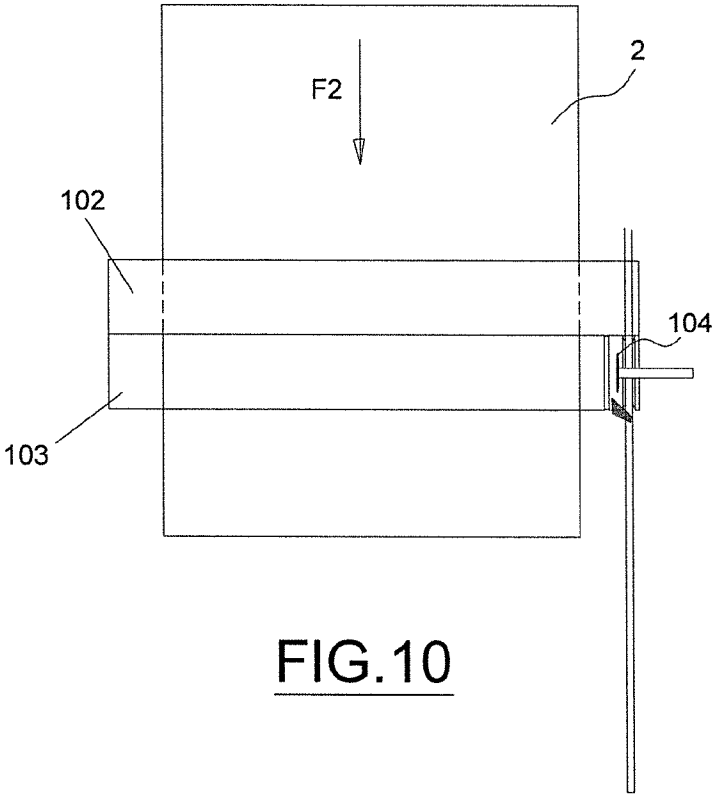
FIG. 10 schematically represents some components of the threading mechanism at different stages of the threading process.
Figure 9:
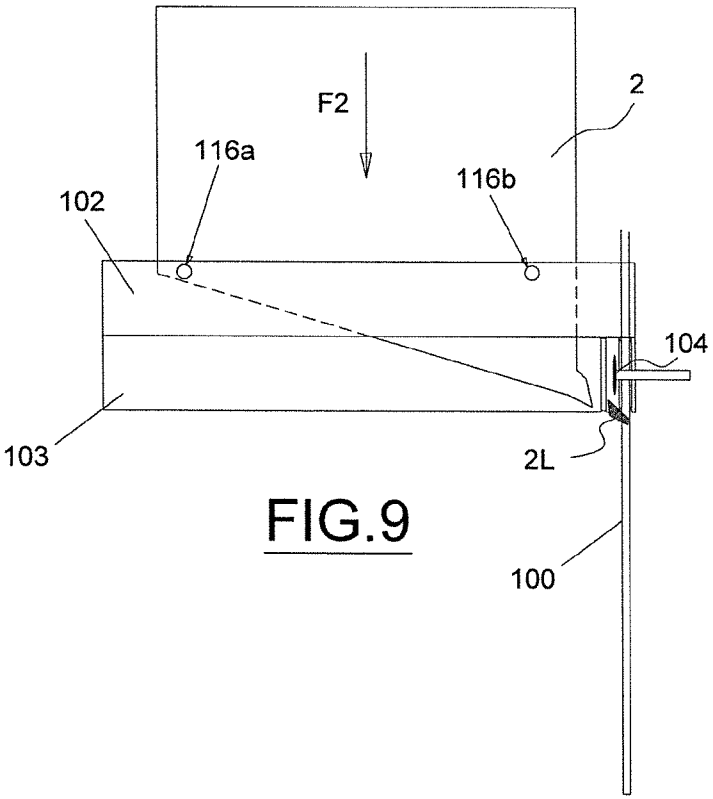
FIG. 9 schematically represents some components of the threading mechanism at different stages of the threading process.
Figure 12:
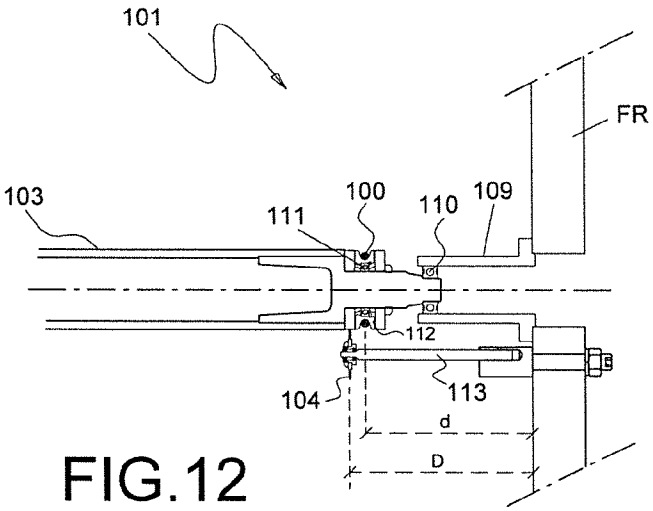
FIG. 12 is a schematic plan view of the detail of FIG. 11 with some portions removed to better highlight others.

The upper press roller (102) is an idle roller, while the lower press roller (103) is motorized. In addition, the upper roller (102) is mounted on a support (105) allowing to adjusts the pressure exerted by the upper roller on the lower roller (103) by means of a lever (106) controlled by a control screw (107) acting on the same lever (106) that serves as a connecting member between the adjusting screw and the upper roll support. The adjusting screw (107) can be electrically actuated by means of a respective actuator (108). The lower press roller (103) is secured to a fixed part (FR) of the rewinder (RW) at each of its ends by means of a connecting flange (109) in which a respective end of the roller (103) is inserted with the interposition of a bearing (110). At its end (right end in the example shown in FIG. 12), the lower roller (103) has a groove in which the dragging belt (100) is guided. Said groove is defined by a pulley (111) mounted on said end of the roller (103) through a corresponding bearing (112). The blade (104) is preferably a fixed blade mounted on an arm (113) that is also fixed to the fixed structure (FR) of the rewinder (RW). The arm (113) and the blade (104) are positioned downstream of the pulley (112) with respect to the direction followed by the flap (2L) engaged to the dragging belt (100). Furthermore, the blade (104) is positioned at a predetermined distance (D) from the fixed structure (FR) greater than the distance (d) of the pulley groove (112) from the same structure (FR). In other words, the blade (104) is more distant from the structure (FR) than the pulley groove (112) where the dragging belt (100) is guided. Therefore, when the flap (2L) attached to the dragging belt (100) passes through the dragging unit (101), since the belt (100) is to the side of the blade (104) (to the right of blade 104 in the example) the latter acts on the web (2) by cutting the flap (2L) so that the web (2) is released from the dragging belt and the production of the logs can be started as further described below. The steps now described are also shown in FIGS. 7-10. In particular, FIG. 7 shows the flap (2L) of the web (2) still hooked to the dragging belt (100). In FIG. 8 the flap (2L) is not visible since this is a perspective view. FIG. 9 and FIG. 10 show the flap (2L) hooked to the belt (100) and cut by the blade (104). In FIG. 10, the web (2) is released from the belt (100). In FIG. 7-10, the arrow "F2" indicates the direction from which the web (2) comes.

Then, the dragging unit (101) is configured to operate both the threading of the belt (2) and the cutting of the flap (2L) of the latter hooked to the belt (100).

Figure 1:
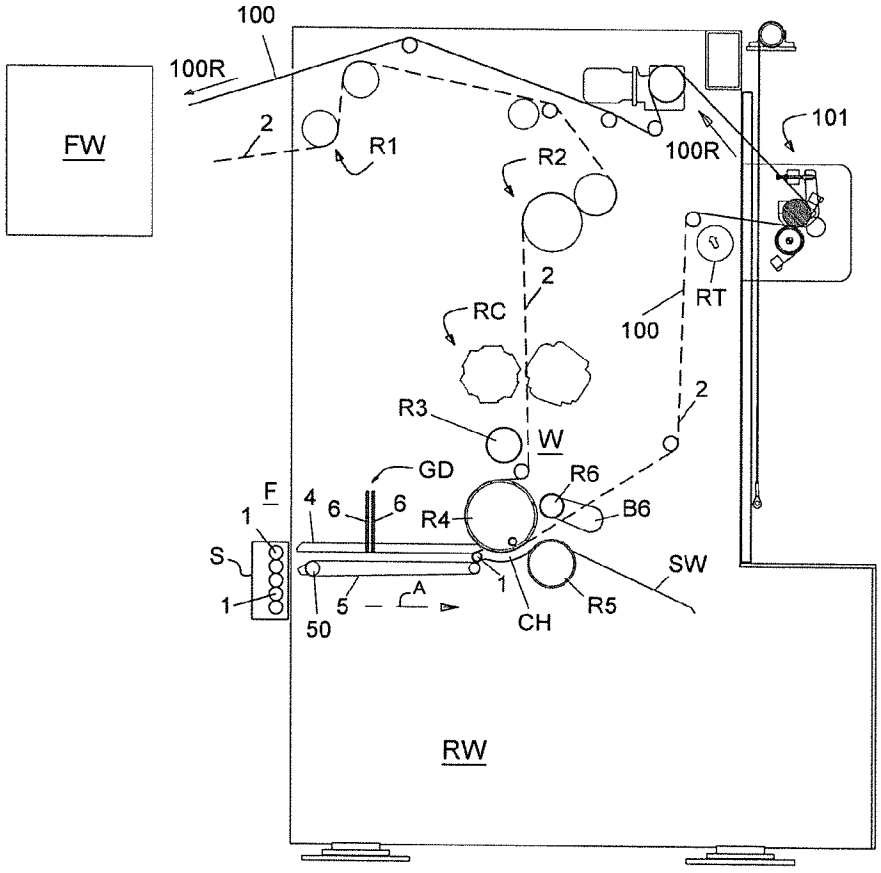
FIG. 1 schematically shows the basic functional groups of a rewinder (RW) according to the present invention, some of which are not shown in the other drawings for simplification.

In FIG. 2, the web (2) is not shown because it has not yet been conveyed to the rewinder (RW). However, the dragging belt (100) is represented, whose forward part (part moving towards the unit 101) follows a path parallel to that which will be subsequently followed by the web (2) as mentioned above. Since in FIG. 2 the rewinder (RW) is represented in side view, said paths appear to be coincident but actually they are not exactly coincident. The return part of the bumper threading (100), that is, the part of the dragging belt moving toward the unwinders arranged in the web feed station (FW), is developed along a path different from the path followed by said forward part. In FIG. 1, the path of the web (2) and the path of the forward part of the belt (100) is represented by dashed lines, while the belt (100) return part is represented by a continuous line. The "100R" arrows indicate the movement of the belt (100) return part.

In FIG. 2 the arrows "100A" and "100R" respectively show the movement of the forward part and the movement of the return part of the dragging belt (100).

Figure 4:
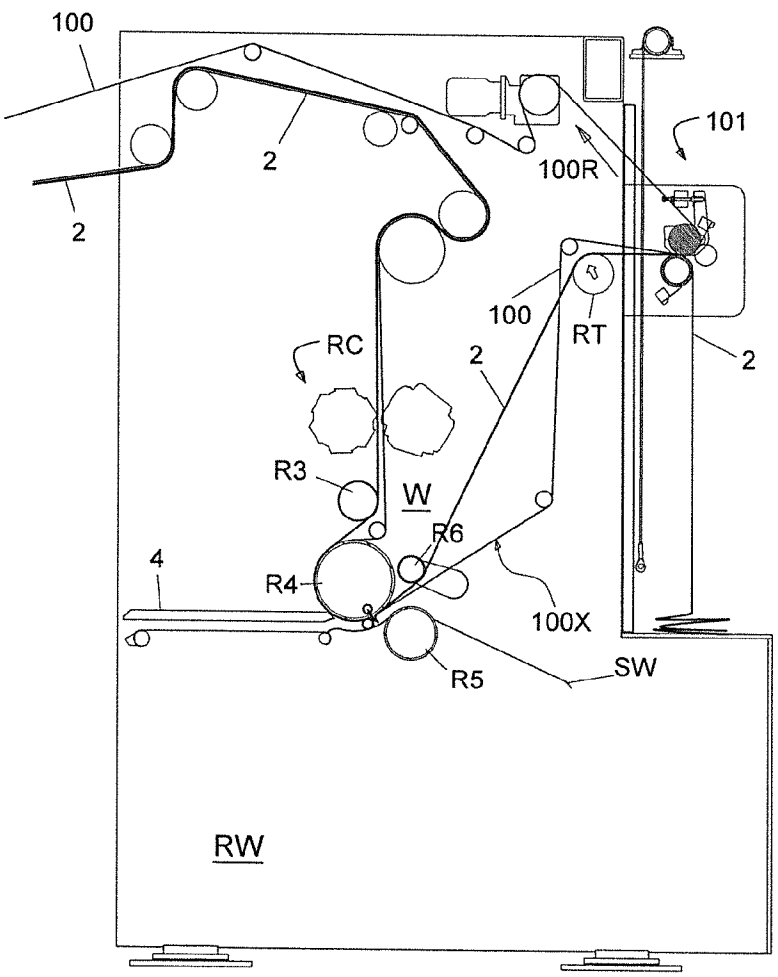
FIG. 4 represents a sequence of operative phases implemented by the machine of FIG. 1, some detail of the machine being omitted to better illustrate others.
Figure 3:
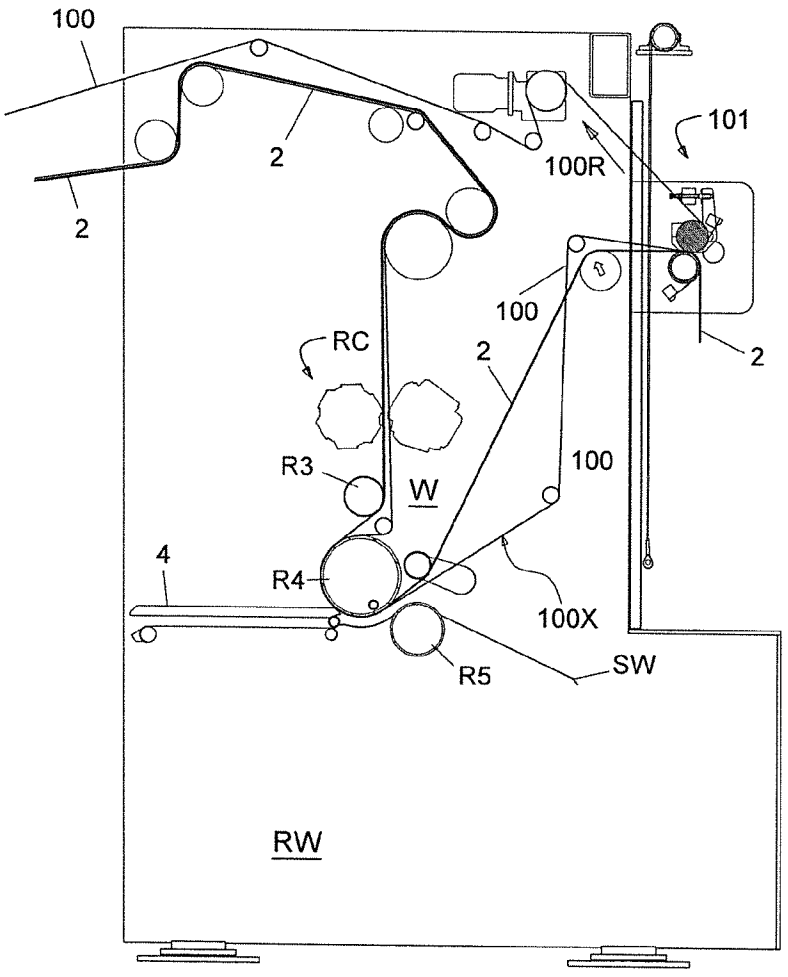
FIG. 3 represents a sequence of operative phases implemented by the machine of FIG. 1, some detail of the machine being omitted to better illustrate others.
Figure 6:
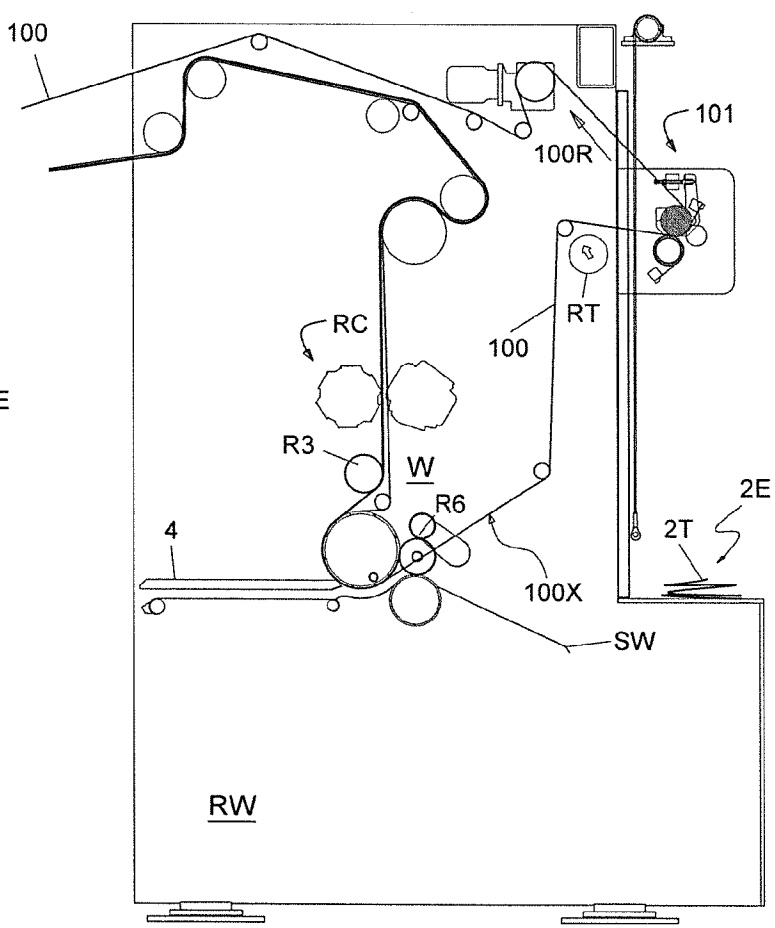
FIG. 6 represents a sequence of operative phases implemented by the machine of FIG. 1, some detail of the machine being omitted to better illustrate others.
Figure 5:
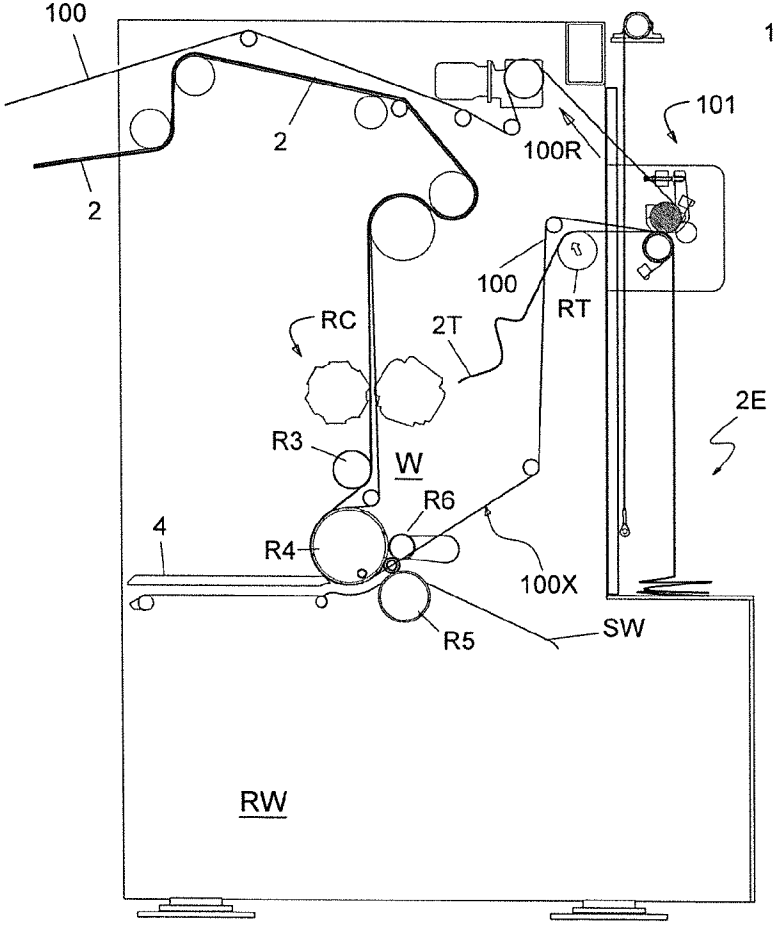
FIG. 5 represents a sequence of operative phases implemented by the machine of FIG. 1, some detail of the machine being omitted to better illustrate others.

Starting from the condition shown in FIG. 2, the operator, after having hooked the flap (2L) to the belt (100) upstream of the rewinder (RW), starts the threading step: while the machine (RW) and the pre-cutting rollers (RC) are activated, the belt (100) drags the web (2) along the predetermined path through the rollers (R1, R2, R3, RC, R4, R5, R6) up to the press rollers (102, 103); at the end of this phase, the web (2) is in the configuration shown in FIG. 3 and passes on a further roller (RT) equipped with a load cell, the function of which is disclosed below, placed at an intermediate position between the winding station (W) and dragging unit (101). In particular, it is noted that the web (2) has passed through the rollers (102,103) so that the flap (2L) has been cut by the blade (104) as disclosed above. Therefore, the web (2) is released from the dragging belt (100). The rollers (102, 103) continue to drag the web (2) until the load cell of roller (RT) detects a predetermined value indicative of a correct web tensioning (FIG. 4). At this point, a core (1) is introduced into the guide (4, 5). When the core (1) reaches the winding station (W), it is commanded the tear of the web (2) along a pre-cutting line thereof downstream of the winding station (W), where the production of the first log starts (FIG. 5). In practice, the threading thus operated is an initial stage in the production of logs. For example, said web (2) tearing is obtained by delivering a compressed air jet to the selected pre-cutting line as described in U.S. Pat. No. 9,079,738. It is understood, however, that the cut of the web (2) at the pre-cutting line can be obtained in any other suitable manner. In FIG. 5, the tail of the web (2) downstream of the station (W) is indicated by the reference "2T". The rollers (102, 103) continue to rotate until the tail (2T) of the ribbon (2) is released from the rewinder (RW). Excess paper (2E), i.e. the part of the paper web (2) that has been separated from the one that winds on the cores to produce the logs, accumulates out of the rewinder and is taken away by the operator (FIG. 6).

Figure 11:
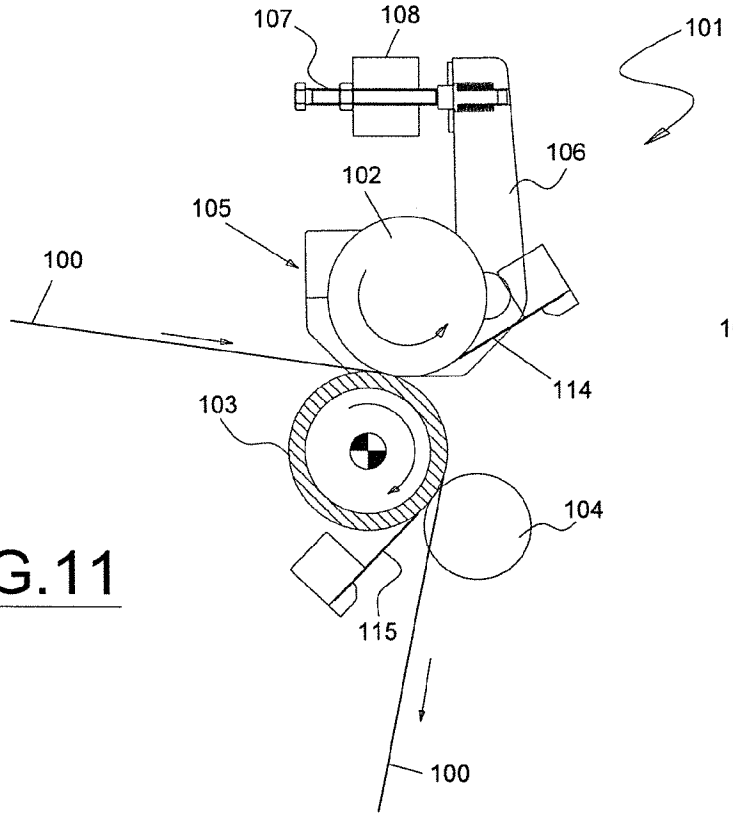
FIG. 11 is an enlarged detail of FIG. 1.
Figure 14:
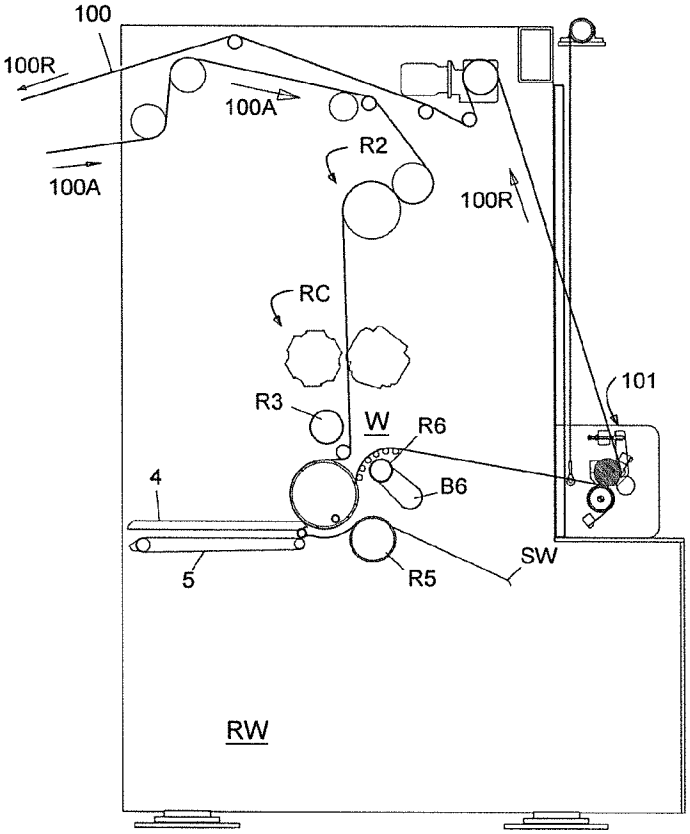
FIG. 14 is view similar to those of FIGS. 1-6 but they show a different configuration of a rewinder according to the present invention.
Figure 13:
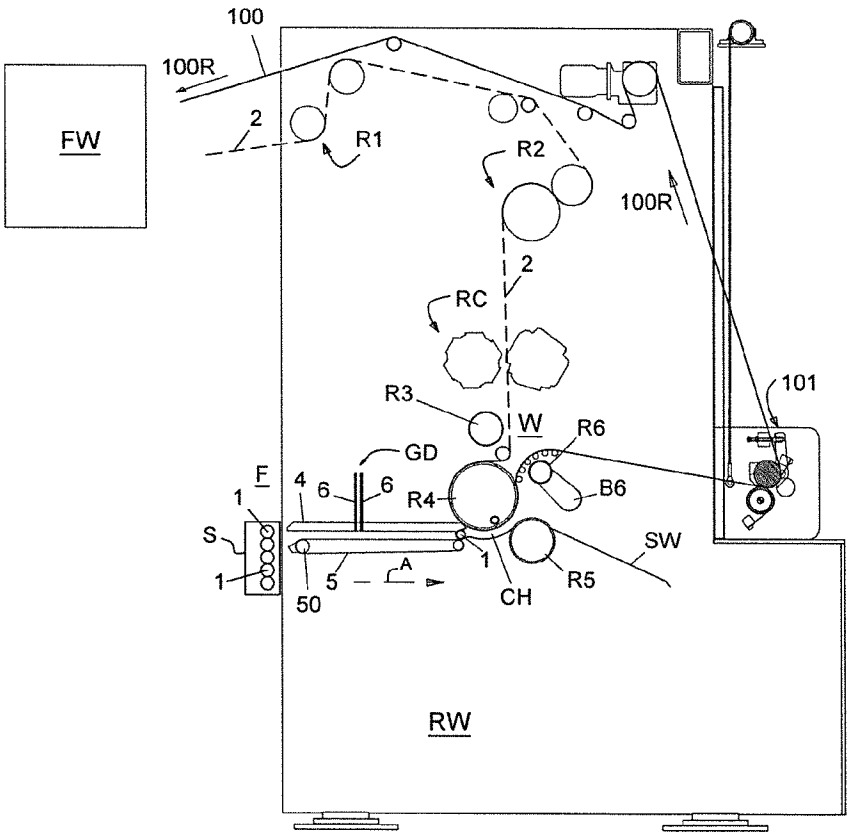
FIG. 13 is view similar to those of FIGS. 1-6 but they show a different configuration of a rewinder according to the present invention.
Figure 16:
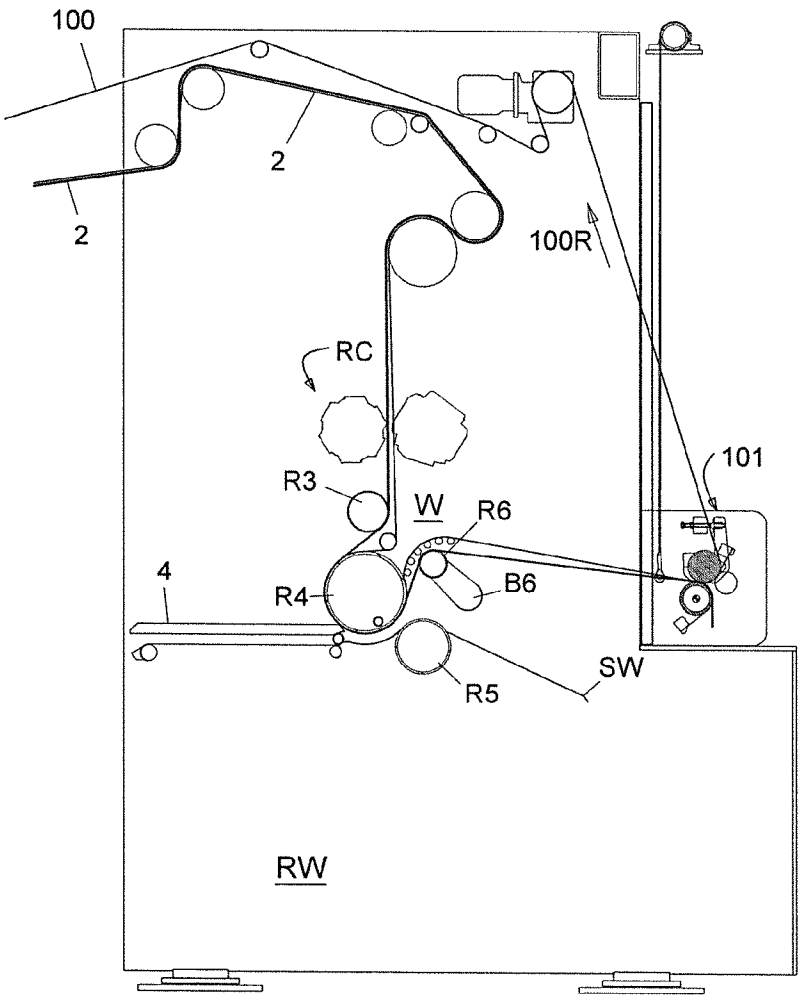
FIG. 16 is view similar to those of FIGS. 1-6 but they show a different configuration of a rewinder according to the present invention.
Figure 15:
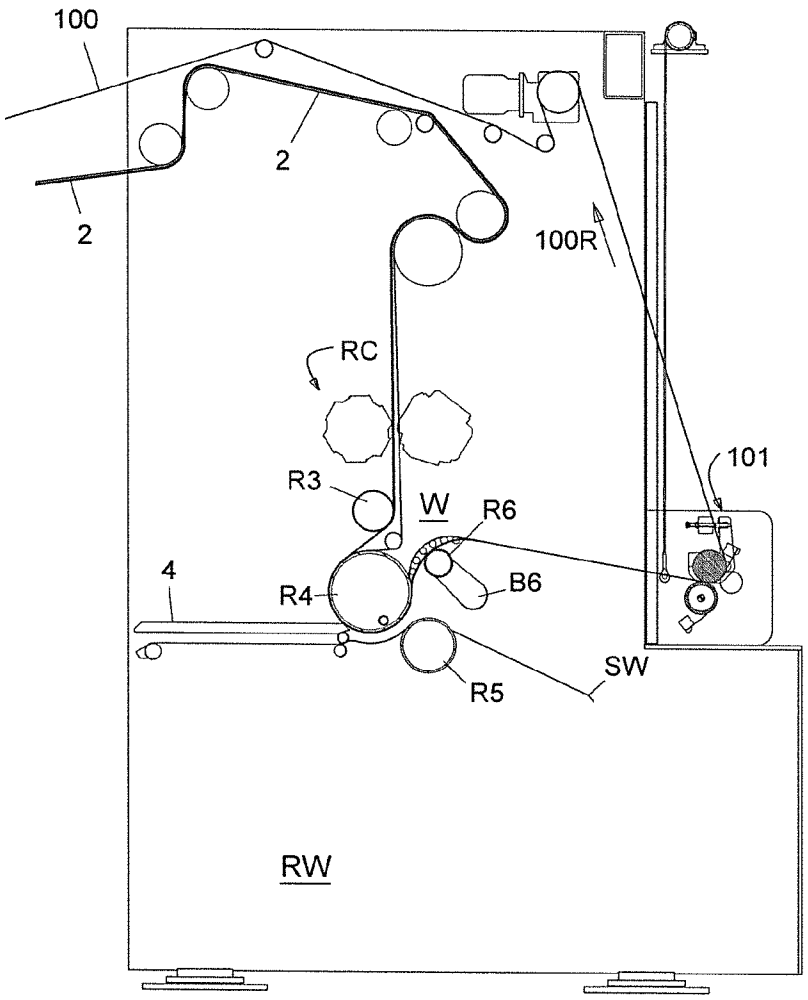
FIG. 15 is view similar to those of FIGS. 1-6 but they show a different configuration of a rewinder according to the present invention.
Figure 18:
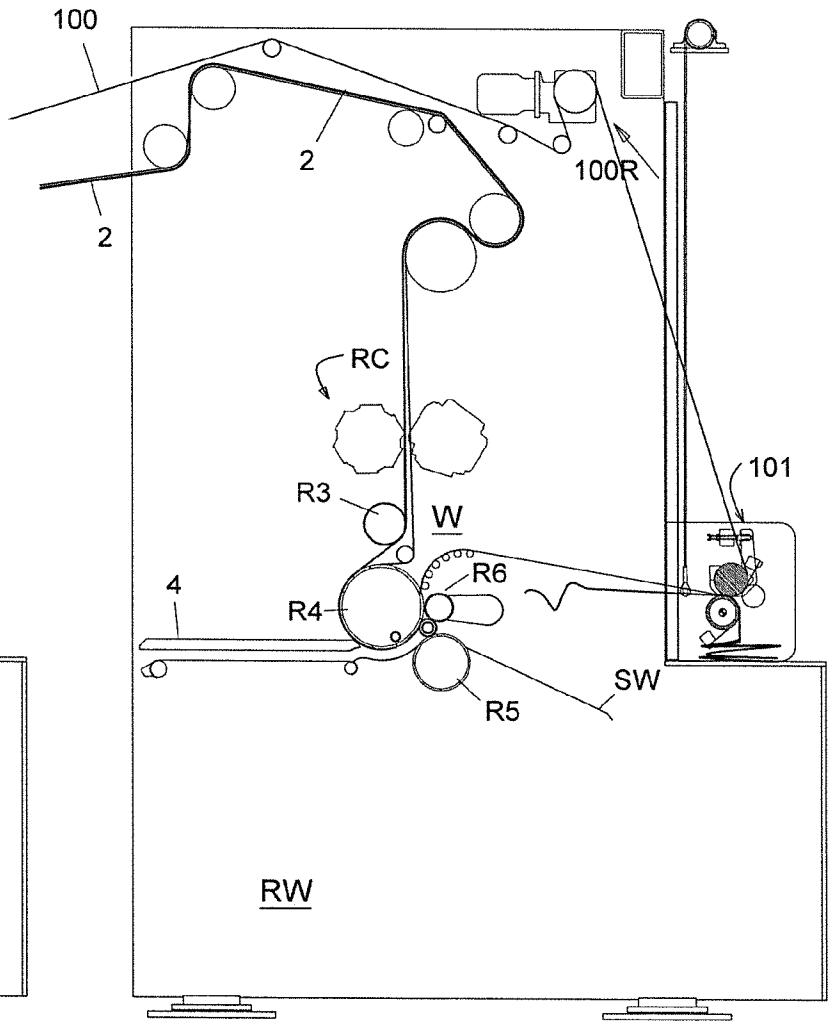
FIG. 18 is view similar to those of FIGS. 1-6 but they show a different configuration of a rewinder according to the present invention.
Figure 17:
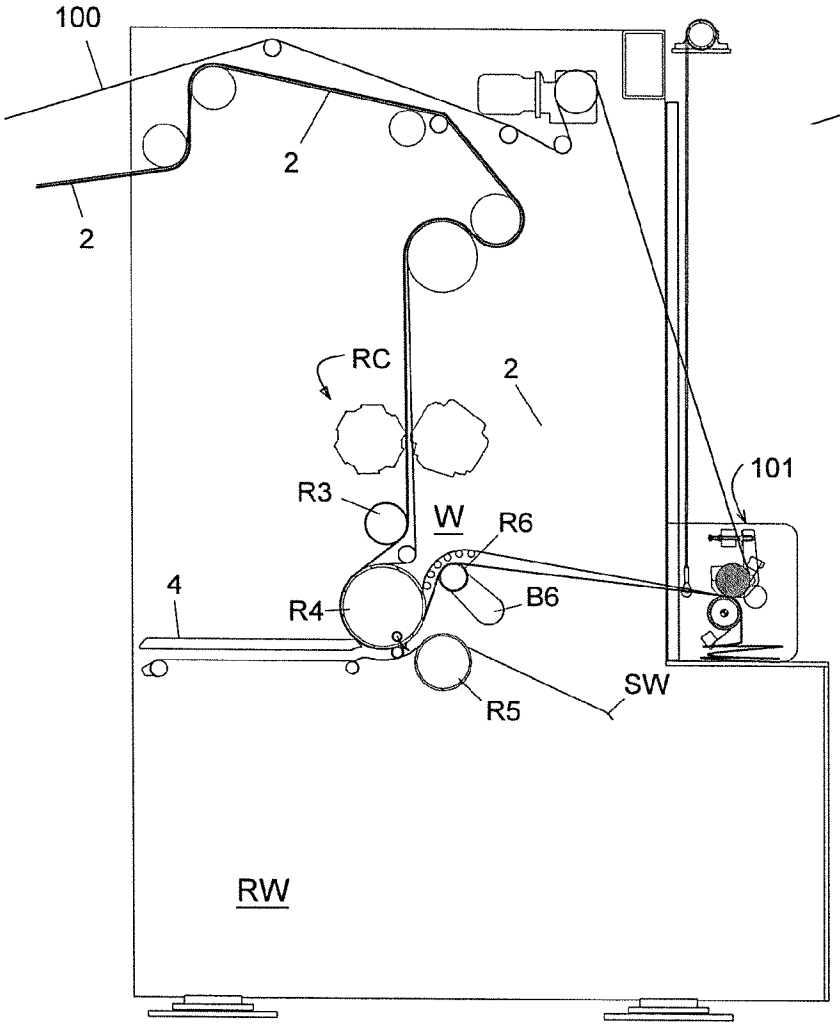
FIG. 17 is view similar to those of FIGS. 1-6 but they show a different configuration of a rewinder according to the present invention.
Figure 19:
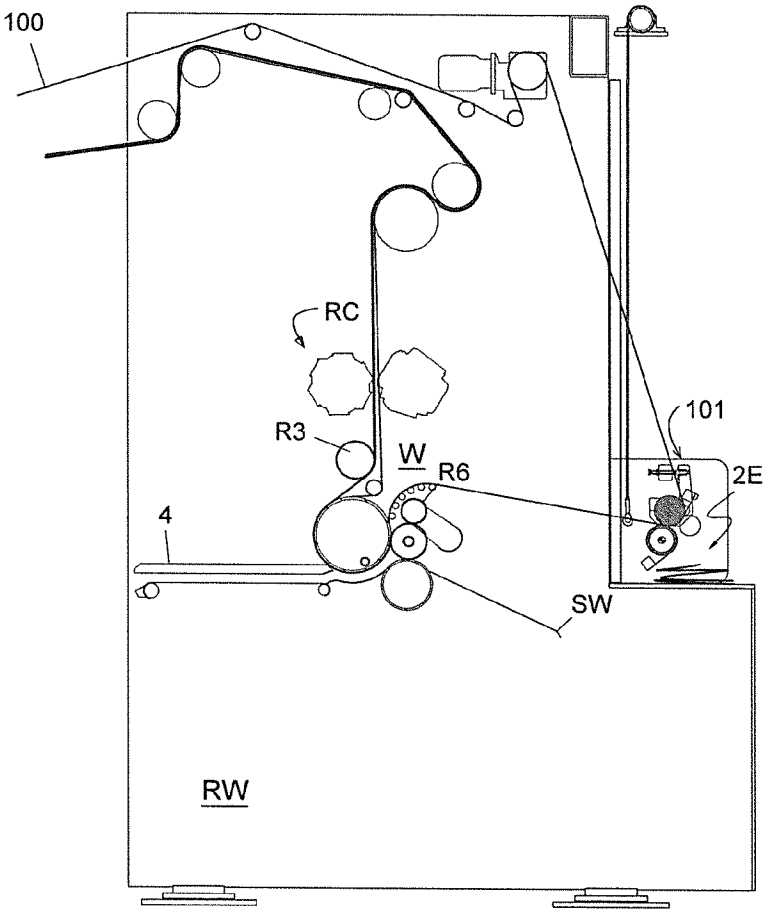
FIG. 19 is view similar to those of FIGS. 1-6 but they show a different configuration of a rewinder according to the present invention.
Figure 21:
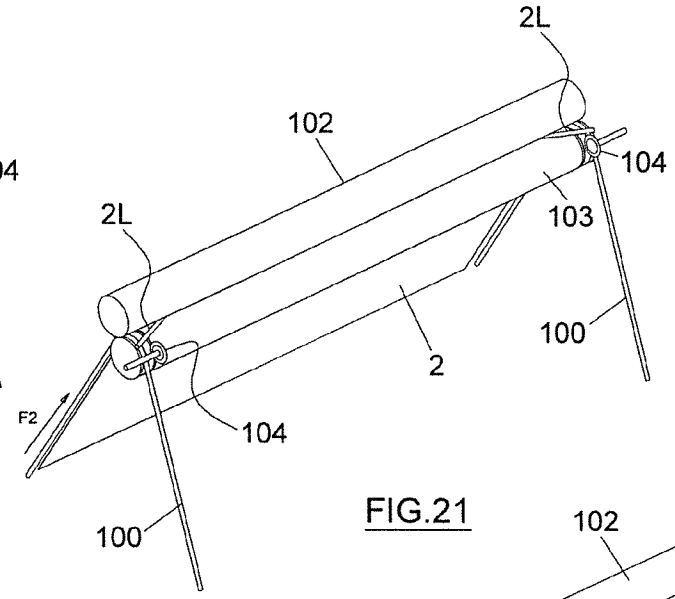
FIG. 21 is view similar to those of FIGS. 7-10 but they show a different configuration of the threading mechanism at different stages of the threading process.
Figure 20:
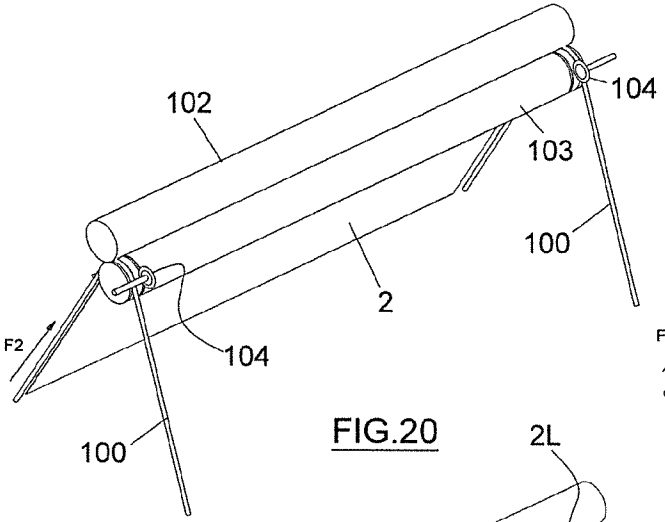
FIG. 20 is view similar to those of FIGS. 7-10 but they show a different configuration of the threading mechanism at different stages of the threading process.
Figure 23:
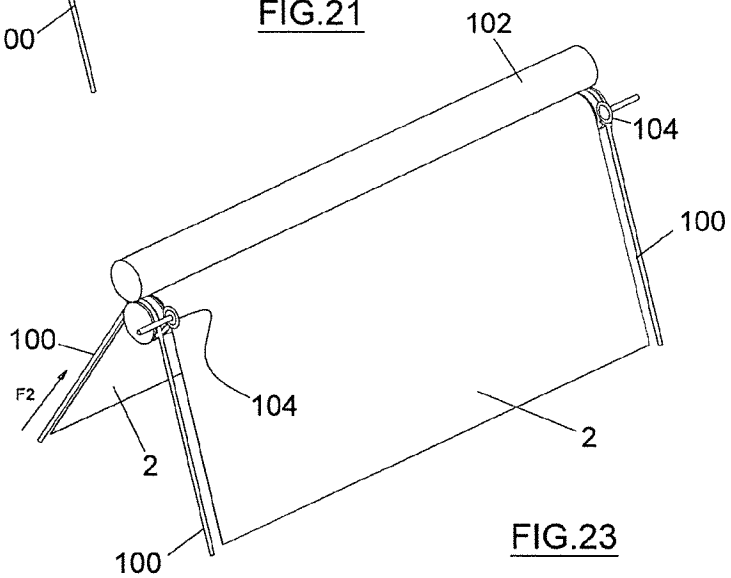
FIG. 23 is view similar to those of FIGS. 7-10 but they show a different configuration of the threading mechanism at different stages of the threading process.
Figure 22:
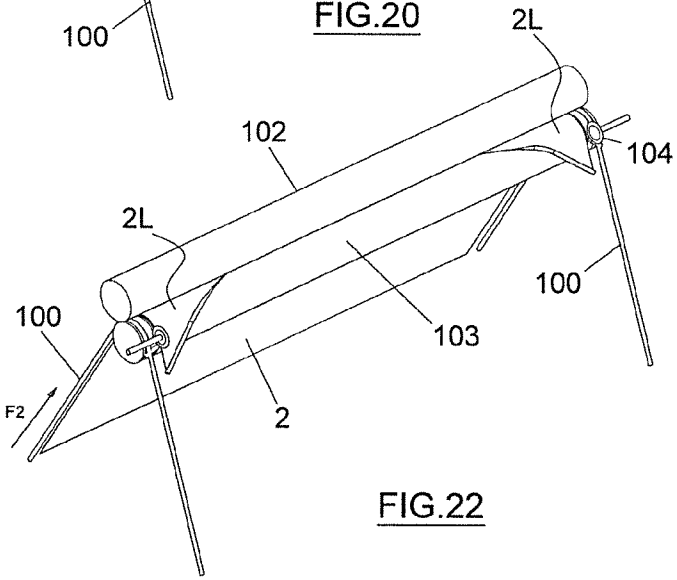
FIG. 22 is view similar to those of FIGS. 7-10 but they show a different configuration of the threading mechanism at different stages of the threading process.

In FIGS. 3 to 6, the web (2) is represented by a line thicker than the other lines to better highlight it. As shown in FIG. 11, downstream of each of the pressure rollers (102, 103) of the unit (101) is positioned a corresponding doctor blade (114, 115) which prevents the web (2) from being rewound on the same rollers. For example, the dragging belt (100) is of the type described in EP2909120B1.

The tension of the paper web can also be controlled by means of a torque limiting clutch on the motorized roller (103) of the drive unit.

From the foregoing description it is evident that the dangerousness of the paper web threading is diminished to the benefit of the operators safety; that it is possible to reduce the wastes when the rewinder is started, since the first log is already produced with the paper properly tensioned; that the threading operation can be easily automated and therefore it does not have to be necessarily entrusted to highly skilled and trained personnel; that the threading mechanism provided with a rewinder according to the present invention is structurally and functionally simple and also allows to reduce the time required to execute the threading; and that existing rewinders can be modified with relative simplicity to make them conform to the invention as the very logs production cycle is not changed compared to conventional procedures.

In the example shown in FIGS. 1-6, the dragging belt (100) has a part (100X) downstream of the roller (R6), i.e. to the right of the roller (R6) in the drawings. In the example shown in FIGS. 13-19, said part (100X) of the dragging belt (100) is upstream of the roller (R6), i.e. to the left of the roller (R6) in the drawings. In the configuration of FIGS.

13-19 the roller (R6), which is a motorized roller, can be used to assist the action of the belt (100). In fact, during the threading step (step in which the roller R6 is not used for logs production) the roller (R6) can be rotated in a direction assisting the threading of the paper web (2): with reference to the drawings, the roller (R6) can be rotated clockwise and, when the threading of the paper web is completed, that is, when the production of the logs begins, the roller (R6) can be rotated counterclockwise (i.e. in the direction that produces the winding of the paper web 2 on the cores 1). By adopting this configuration for the belt (100), the dragging (101) may be arranged at a lower height than in the case exemplified in FIGS. 1-6.

In accordance with the example shown in FIGS. 20-23, two dragging belts (100) are provided which move on two parallel paths along the two sides of the rewinder. The use of two dragging belts may allow two flaps (2L) of the paper web (2) to engage the threading mechanism, i.e. to hook one flap (2L) to a belt (100) and another flap (2L) to another belt (100). In this case, as shown in FIGS. 20-23, two blades (104), i.e. a blade (104) for each side of the roller (103), are provided. Each of the two blades (104) in this example cuts the corresponding flap (2L) of the paper web (2).

More in general, a rewinder for the production of paper logs according to the present invention comprises:

means (R1, R2, R3, RC) adapted to guide and transversely pre-cut a paper web (2) along a predetermined path, means (R4, R5, R6) adapted to wind a predetermined amount of the paper web (2) on a core (1) in a winding station (W), and a threading mechanism for threading the web (2) along said path, wherein the threading mechanism comprises a dragging unit (101) provided with dragging means (102, 103) adapted to engage the web (2) to drag it along said path with a predetermined feed direction (F2) and at least one dragging member (100) adapted to engage a respective flap (2L) of the web (2) in a dragging step preceding the production of the logs, and said dragging unit (101) is located downstream of said winding station (W) with respect to said feed direction (F2) of the paper web (2) and is provided with release means (104) adapted to release said flap (2L) of the web (2) from the dragging member, the release means (104) being arranged downstream of the dragging (102, 103) so as to intercept the flap (2L) of the web (2) and disengage it from the dragging (100) while the web (2) is fed along said direction (F2) by the dragging means (102, 103).

According to the examples disclosed above, the dragging member is a flexible dragging member. In particular, the dragging member can be a dragging belt of the type previously indicated.

Furthermore, in accordance with the examples previously disclosed, the at least one dragging member (100) is arranged laterally to the dragging means (102, 103).

According to the examples disclosed above, the release means for releasing the paper web (2) from the dragging means comprise one or more blades (104).

According to the examples disclosed above, the dragging means are constituted by rollers (102,103) forming a nip crossed by the web (2) in the threading step. The pressure in the nip is adjustable. One of the rollers (102, 103) can be coated with an elastic material, such as rubber, limiting its traction capacity in relation to the pressure in the nip.

According to the examples disclosed above, the tensioning of the paper web can be controlled by electronic or mechanical control means.

The paper web tensioning step can also be started in accordance with the detection performed by means, for example optical means comprising photocells (116*a*, 116*b*) suitably provided close to the dragging unit (101), which detect the complete passage of the web (2) through the same unit (101). With reference to the example schematically shown in FIGS. 7 and 9, in which the photocells (116*a*, 116*b*) are located above the dragging unit, when the web (2) is in the position of FIG. 7 only one photocell (116*b*) reads its presence, while when the web (2) is in the position of FIG. 9, both photocells (116*a*, 116*b*) detect the presence of the web (2). This latter condition corresponds to the transit of both the side edges of the web (2) through the dragging unit and then a programmable control unit (not visible in the drawings) which receives and processes the signals of the optical means (116*a*, 116*b*), activates said tensioning step. In practice, execution details may however vary in an equivalent manner to the individual elements described and illustrated without departing from the scope of the solution idea adopted and therefore remaining within the scope of the protection conferred by this patent.

The invention claimed is:

1. Rewinder for the production of paper logs, comprising means adapted to guide and transversely pre-cut a paper web along a predetermined path, means adapted to wind a predetermined amount of the paper web on a core in a winding station, and a threading mechanism for threading the web along said path, wherein the threading mechanism comprising:

a dragging unit provided with dragging means adapted to engage the web to drag it along said path with a predetermined feed direction and at least one dragging member adapted to engage a respective flap of the web in a dragging step preceding the production of the logs, and said dragging unit is located downstream of said winding station with respect to said feed direction of the paper web and is provided with release means adapted to release said flap of the web from the dragging member, the release means being arranged downstream of the dragging means so as to intercept the flap of the web and disengage it from the dragging means while the web is fed along said direction by the dragging means.

2. The rewinder according to claim 1, wherein the at least one dragging member is a flexible member.

3. The rewinder according to claim 1, wherein the at least one dragging member is a dragging belt.

4. The rewinder according to claim 1, wherein said at least one dragging member is arranged laterally to the dragging means.

5. The rewinder according to claim 1, wherein the release means for releasing the paper web (2) from the dragging means comprise one or more blades.

6. The rewinder according to claim 1, wherein said dragging means are constituted by rollers forming a nip crossed by the web in the threading step.

7. The rewinder according to claim 6, wherein the pressure in the nip is adjustable.

8. The rewinder according to claim 1, wherein it comprises means adapted to control the tensioning of the web subsequent to said dragging step.

9. The rewinder according to claim 8, wherein the means controlling the tensioning of the web are electronic control means.

10. The rewinder according to claim 8, wherein the means controlling the tensioning of the web are mechanical control means.

11. The rewinder according to claim 1, wherein the dragging unit comprises means adapted to detect the presence of both the side edges of the web.

* * * * *